United States Patent [19]
Caponi
[11] 4,444,119
[45] Apr. 24, 1984

[54] FAST RESPONSE IMPULSE GENERATOR

[75] Inventor: Elso R. Caponi, Longwood, Fla.

[73] Assignee: The United States of America as represented by the Secretary of the Army, Washington, D.C.

[21] Appl. No.: 394,566

[22] Filed: Jul. 2, 1982

[51] Int. Cl.[3] ..... F42B 3/04
[52] U.S. Cl. ..... 102/530; 244/3.21; 244/3.22; 102/202.5
[58] Field of Search ..... 102/530, 430, 531, 374, 102/202.5, 202.14, 204; 244/3.21, 3.1, 3.22

[56] References Cited

U.S. PATENT DOCUMENTS 3,028,807 4/1962 Burton et al. ..... 244/3.22 X
3,034,434 5/1962 Swaim et al. ..... 244/322
4,176,814 12/1979 Albrektsson et al. ..... 244/3.21 X

*Primary Examiner*—Harold J. Tudor
*Assistant Examiner*—Tyrone Davis
*Attorney, Agent, or Firm*—John H. Raubitschek; Arthur I. Spechler; Harold W. Hilton

[57] ABSTRACT

An impulse generator for providing an impulsive force substantially normal to the axis of a missile to provide the missile with the desired angle of attack. The device includes radial explosive paths to its periphery and from each point on the periphery detonation is transferred to the periphery of the main charge causing it to implode.

3 Claims, 2 Drawing Figures

FAST RESPONSE IMPULSE GENERATOR

DEDICATORY CLAUSE

The invention described herein was made in the course of or under a contract or subcontract thereunder with the Government and may be manufactured, used, and licensed by or for the Government for governmental purposes without the payment to me of any royalties thereon.

BACKGROUND OF THE INVENTION

Various methods have been utilized to guide a missile to a target. Moveable vanes and fluid injection means have been relied upon to turn the missile and provide the missile with an angle of attack. Other systems include nozzles around the periphery of a spinning missile which are fired in predetermined sequence to provide a thrust substantially normal to the missile axis.

Impulse generators may also be relied upon to "translate" the missile to the angle of attack. This is done by exploding charges, which have been placed around the periphery of the missile, so that the charge directs a force substantially normal to the missile axis to "translate" the missile to the desired position. Typically, in presently used generators, the main charge causes damage to the missile structure.

The device of the present invention concentrates explosive energy on impulse and away from structure.

It is an object of the present invention, therefore, to provide an increased impulse from an impulse generator by more efficient coupling of the explosive energy to the impulse mass than to the supporting structure.

SUMMARY OF THE INVENTION

An electrically initiated explosively driven impulse generator having a circular initiation structure causing implosion of the explosive charge. The device includes an electrical initiator bridge which is centrally located on an inert substrate with radial explosive paths to its periphery. From each point on the periphery, detonation is transferred to the periphery of the main charge causing it to implode.

DESCRIPTION OF THE PREFERRED EMBODIMENT

Figure 1:
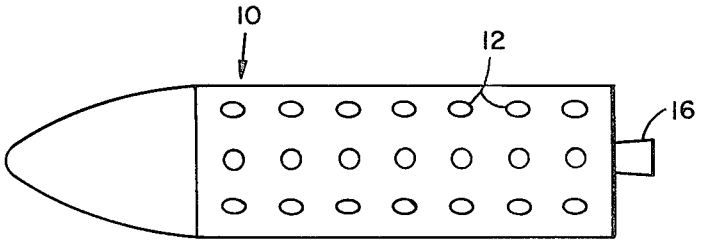
FIG. 1 is a diagrammatic pictorial view of a missile utilizing impulse generators of the present invention.
Figure 2:
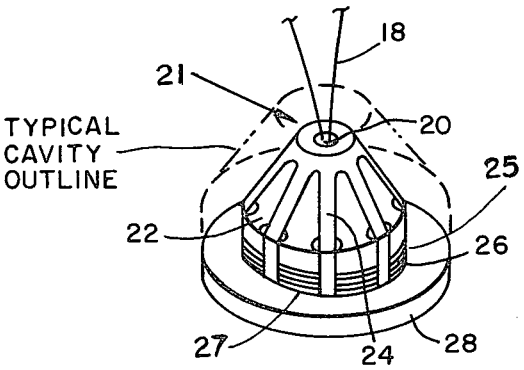
FIG. 2 is a pictorial view of the impulse generator of the present invention.

As seen in FIG. 1, a missile 10 is provided with a plurality of impulse generators 12 around the periphery thereof. Each impulse generator is positioned in a cavity 14 (FIG. 2). The cavities may be arranged in rows. The missile is provided with a main propulsive motor 16 for propelling the missile to a target.

As seen in FIG. 2, impulse generator 12 includes an electric initiator means 18 connected to an initiator bridge 20 which is centrally located on the upper surface 21 of an inert substrate 22, such as polycarbonate. Bridge 20 is provided with radial explosive paths 24 on the periphery of the substrate. Through each radial path, detonation is transferred to the outer periphery surface 25 of a main charge 26. An impulse disc 28 is provided adjacent the lower surface 27 of charge 26.

One application of the impulse generator of the present invention is as a rapid control surface for a spin stabilized impulsively controlled missile. The missile is fired and spun to a predetermined spin rate. Typically, the missile includes a radar and associated electronics to acquire a target. Should the missile be off target the electronics of the missile (not shown) will sense the amount of deviation and fire predetermined ones of the impulse generators to produce a force substantially normal to the missile axis and translate the missile to the desired angle of attack. Such missile electronics is well known and is not encompassed in the inventive concept of the present invention.

The device of the present invention provides a rapid response control surface for the desired displacement of the missile for impact with the target.

Because of the radial explosive paths, detonation is transferred to the periphery of the main charge causing it to implode and expel the impulse disc to provide a lateral thrust. The resulting implosion couples a larger percentage of the explosive energy to impulse and less pressure to the missile structure. Routing the explosive paths to a number of points on the rear surface of the main charge results in an approximation of surface initiation to the main charge which reduces pressure on missile structure.

I claim:

1. An electrically initiated explosively driven impulse generator comprising:
   a. a body of inert substrate having upper and lower surfaces;
   b. an explosive charge adjacent said lower surface of said inert substrate said explosive charge provided with an outer peripheral surface;
   c. an explosive bridge disposed on said upper surface of said inert substrate; including
   an explosive path means connected to said explosive bridge and including radially extending portions in engagement with said outer peripheral surface of said explosive charge;
   d. electric initiator means disposed on said upper surface of said explosive bridge and connected to said explosive path means, and,
   e. an impulse disc disposed adjacent said explosive charge.

2. A device as in claim 1 wherein said inert substrate is in a frusto-conical configuration.

3. A device as in claim 2 wherein said inert substrate is polycarbonate.

* * * * *